United States Patent [19]

Okubo

[11] 4,265,461

[45] May 5, 1981

[54] COMBINED PLAYTHING AND RECEPTACLE FOR INFANTS

[76] Inventor: Masahisa Okubo, 837-I, Hachigasaki, Matsudo-shi, Chiba-ken, Japan

[21] Appl. No.: 4,893

[22] Filed: Jan. 19, 1979

[30] Foreign Application Priority Data

Jan. 21, 1978 [JP] Japan ..... 53-6068[U]

[51] Int. Cl.[3] ..... A63G 13/10; B62B 13/18

[52] U.S. Cl. ..... 280/1.13; 280/11; 280/30; 272/52.5; 272/64

[58] Field of Search ..... 280/1.1 R, 1.11 R, 1.13, 280/1.188, 1.189, 1.208, 1.22, 1.175, 8, 9, 10, 30, 11; 272/52.5, 52, 64, 101

[56] References Cited

U.S. PATENT DOCUMENTS

| | | | |
|---|---|---|---|
| 2,167,937 | 8/1939 | Clanton | 280/1.22 |
| 2,605,812 | 8/1952 | Benze | 280/30 X |

FOREIGN PATENT DOCUMENTS

| | | | |
|---|---|---|---|
| 446381 | 7/1927 | Fed. Rep. of Germany | 272/64 |
| 2726518 | 12/1978 | Fed. Rep. of Germany | 272/64 |
| 1151139 | 8/1957 | France | 280/8 |
| 538563 | 8/1941 | United Kingdom | 272/64 |

*Primary Examiner*—John A. Pekar

[57] ABSTRACT

This invention discloses a combination of a vaulting box and a wooden horse used as means of plaything for infants, the interior of the vaulting box serving as a receptacle. The upper structural frames may all be received into the lower structural frames so that they may be conveniently stored and carried.

5 Claims, 8 Drawing Figures

A

B

COMBINED PLAYTHING AND RECEPTACLE FOR INFANTS

BACKGROUND OF THE INVENTION

This invention relates to effective multi-purpose playthings intended for use by infants or the like.

It is therefore a primary object of the present invention to make appropriate application to rocking riding-on-horseback playthings like wooden horses and playing vaulting boxes as well as normal wheeled pulling playthings and pulling riding-on-horse playthings.

It is a further object of the present invention to make effective use of such playthings themselves as receptacles for toys or the like, in which case, particularly, the toys or the like may be separately stored.

It is another object of the present invention to adequately achieve individual using modes of play of a single or plural parts, for example, such as only the separated bottom truck or sledge-like rocking runners, or pulling only by the frame itself or upper frame, riding-on-horseback play or playing at housekeeping or playing at position-taking while riding-on-horseback.

It is yet another object of the present invention to provide an arrangement wherein structural frames themselves are successively received into lower frames to conveniently house them and to effectively reduce the cost required for transportation and storing.

It is still another object of the present invention to suitably apply for use with height adjustable stools or chairs or playing tables.

DETAILED DESCRIPTION OF THE INVENTION

Figure 1:
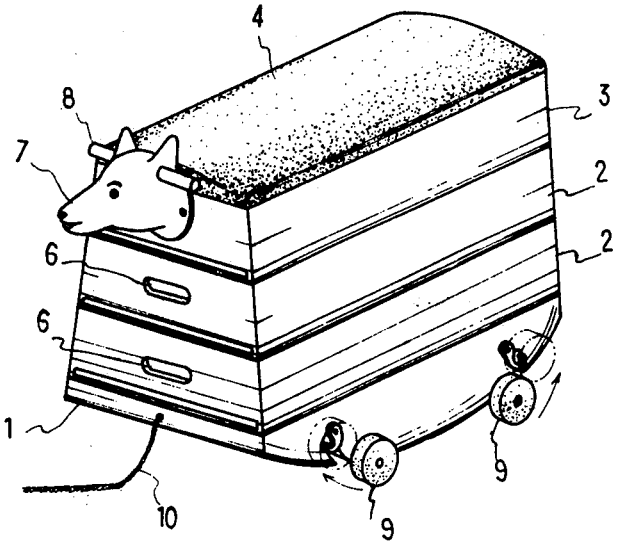
FIG. 1 is a perspective view showing a typical embodiment of the present invention.

The present invention will now be described in detail by way of a typical embodiment shown in the drawings.

Figure 3:
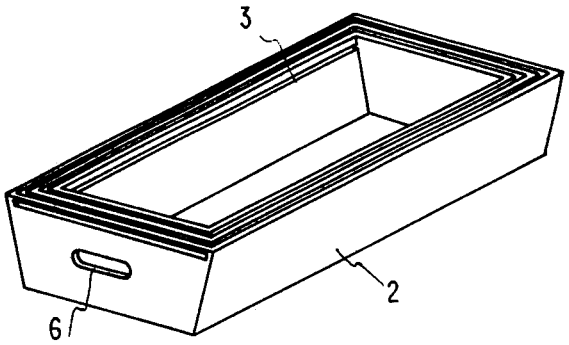
FIG. 3 is a perspective view showing the housing state.

The reference numeral 1 designates a truck, 2 intermediate frames, 3 an upper frame and 4 a top plate formed integrally or separately from the frame 3 to form a cover body. The intermediate frames 2 and the upper frame 3 are basically of the rectangular form (including square, circular and other forms), which are reduced in dimension upwardly to form a frustoconical pyramid (including a frustocone and other configurations) in the form of a similar figure, the upper frames being fitted into the lower frames as seen in FIG. 3. A bottom closure slot 5 positioned at the lower portion of the frames 2 and 3, is designed to be removed and inserted freely when necessary, and holes 6 are suitably bored in the peripheral side surfaces of the frames 2 to remove and insert the bottom cover 5. Then, a false head 7 of an animal (including fanciful being) or the like is removably mounted on the front side of the uppr frame 3 (on the front side of the top plate 4 as the case may be), the head 7 having a holding rod 8 extended sideways therethrough. The top plate 4 is integrally fastened to the upper frame 3 or fitted in an open portion thereof, and the top plate has a suitable cushioning material coated thereon.

Figure 2:
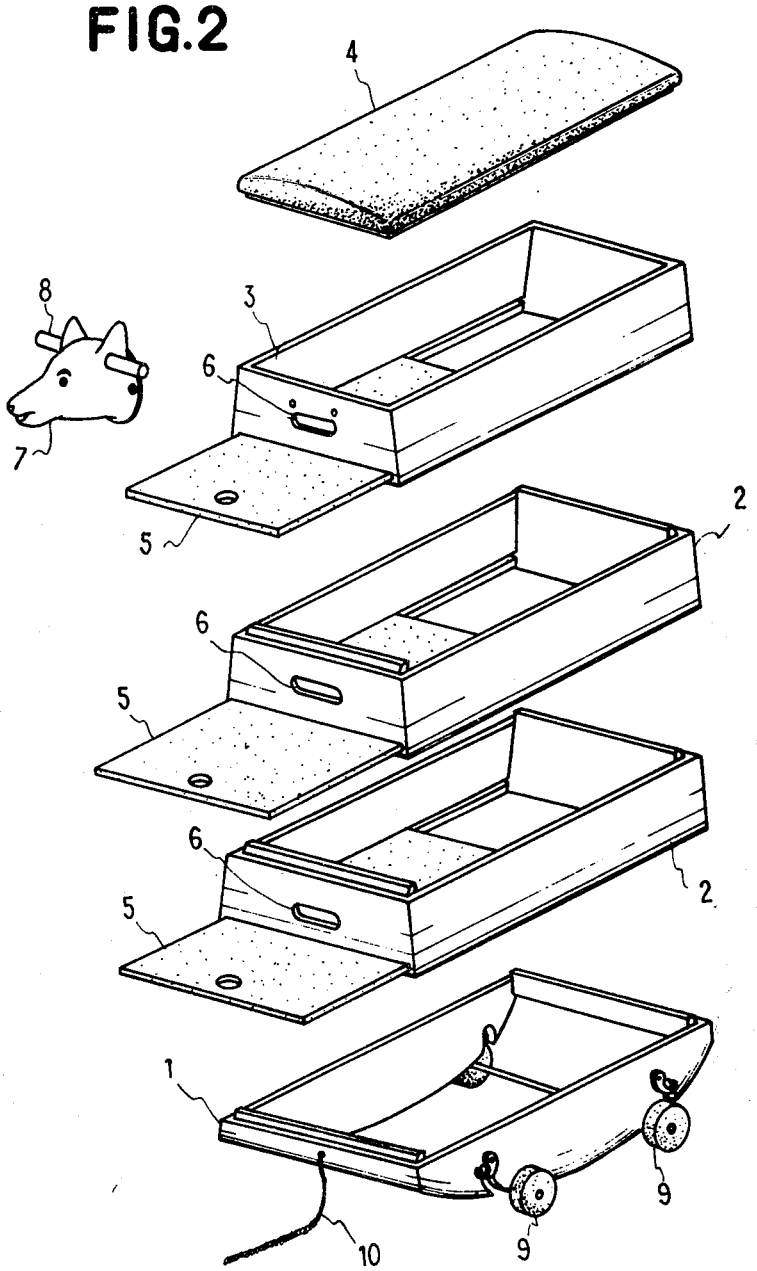
FIG. 2 is an exploded perspective view.
Figure 4:
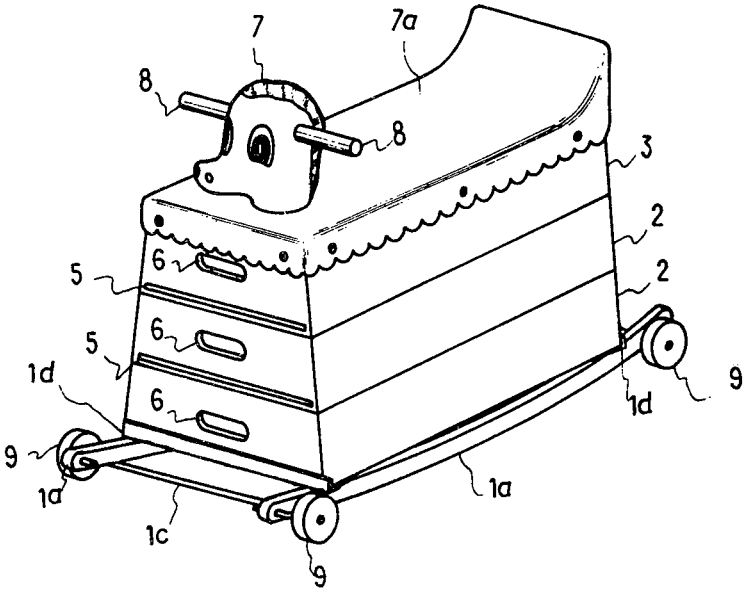
FIG. 4 is a perspective view showing another embodiment.
Figure 5:
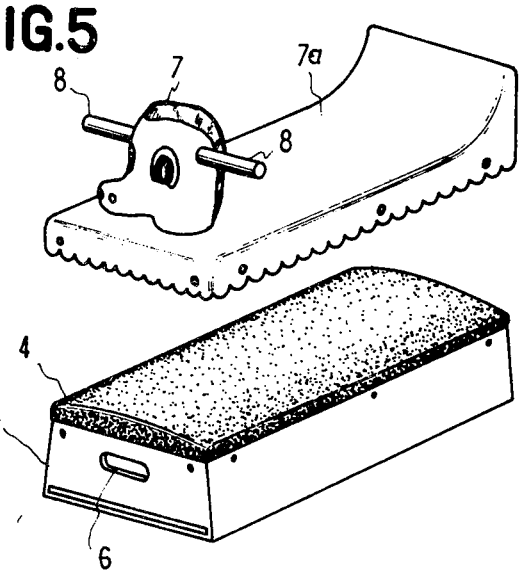
FIG. 5 is an exploded perspective view of the same.
Figure 6:
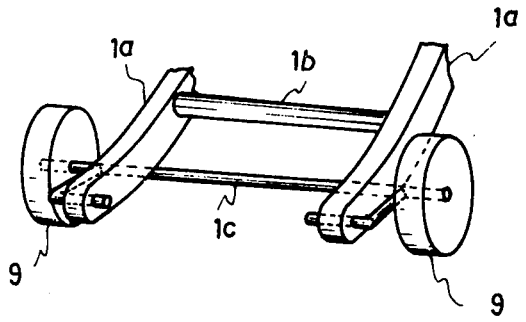
FIG. 6 is a perspective view of a principal part of the same.
Figure 6:
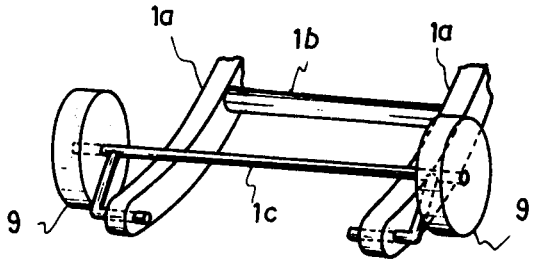

It will be noted in the construction of the false head 7, that the same operation and effect as those of the aforementioned mounting construction of the head, may be obtained even by forming a combined seat and mount **7*a* for the head of the shape and dimension fitted thereafter the top plate 4, said portion 7*a* being fitted over the top plate 4 of the upper frame 3 and suitably fastened thereto as seen in FIG. 4. Returning to FIGS. 1 and 2, the truck 1 adapted to support the frames 2 and 3 has its bottom surface gradually curved with a central portion thereof in the front and rear directions downwardly directed to have sides thereof formed into a circle. The wheels 9, 9 are rotatably journalled on axles which are supported so that the wheels 9, 9 are retractable when necessary into slots formed in the side walls of the tuck so as to permit the lower edge of the bottom surfaces to rest on the ground allow the truck 1** to be rocked forwardly and rearwardly. Hooks are provided to hold the wheels in retracted position.

Figure 7:
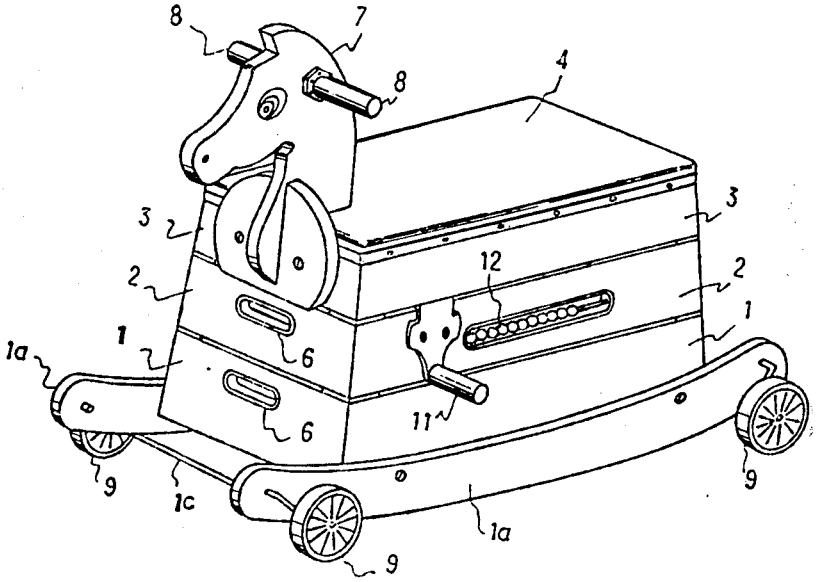
FIG. 7 is a perspective view of showing another embodiment.
Figure 8:
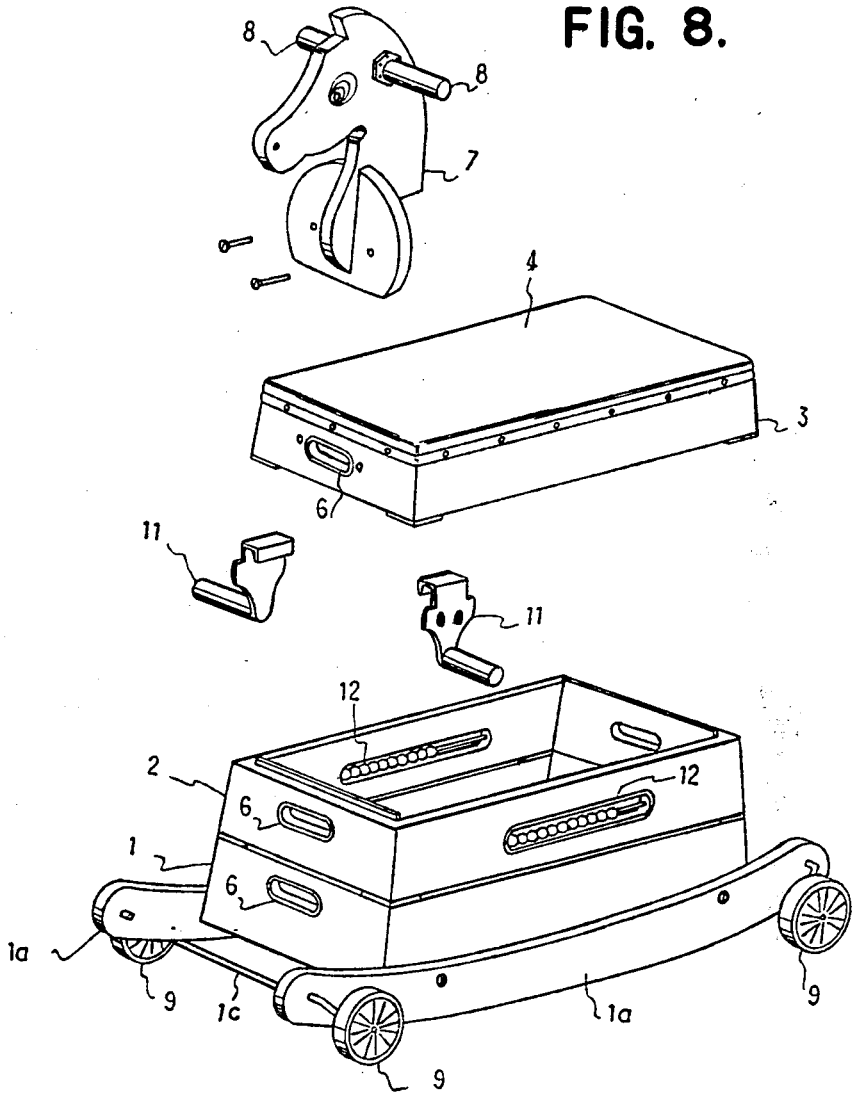
FIG. 8 is an exploded perspective view of the same.

It should be also noted, in the truck construction and rocking construction as described above that the same operation and effect as those described above may be obtained even by an arrangement shown in FIG. 4, two relatively elongated rods **1*a*, 1*a* with opposite ends thereof gradually curved upwardly are connected by support rods 1*b*, 1*b* to form a runners like on a sledge protruded from the frame. A shaft 1*c* having crank-like ends shaft 1*c* is pivotally connected to opposite ends of the rods so as to be rotatable upwardly or downwardly with respect thereto. The wheels 9, 9 are supported on the crank-like shaft 1*c*. Angle braces 1*d*, 1*d* for supporting the frame may be disposed when necessary across the rods 1*a*. In the drawing, 10 designates a rope used to pull the truck 1 and for other purposes. As seen in FIGS. 7 and 8, the construction can be augmented with a removable foot rest 11, and couting beads 12**.

As seen from each of the embodiments, the trucks, either in the form of the lowermost frame member 1, or the sledge formed by runners **1*a*, is separable from the remaining frame members, permitting the frame members to be stacked one on top of the other, as to form a vaulting box, or one within the other for storage. The wheels 9** are retractable, so that in addition to providing use as a wagon, the truck and the convexedly-curved runners permit it to be used as a sledge.

The present invention provides a specific structure as described above. In use, parts are first assembled to provide a pulling plaything, a riding-on-horseback plaything, or a riding-on-horseback rocking plaything such as a wooden horse. Second, similar use can be made only by the truck 1. In a state where the truck 1 is removed, the structure may be used as a vaulting box or a riding-on-horseback plaything by adjusting the height thereof, or as a height-adjustable chair or stool or a play table. The structure may further be used as a housing and arranging plaything, playing at housekeeping, position taking games and other uses by separately using the frames 2 and 3. Such structural characteristics may provide marked actual effects in separate housing as general housing and arranging receptacles to render the arrangement and housing of toys or the like and culture of sentiments by such arrangement and housing effective.

As described above, the present invention relates to the disclosure of a novel combined receptacle and plaything which is simple in construction and can be used for multipurpose.

What is claimed is:

1. A combined receptable and plaything comprising a truck, a box-like structure, removably mounted on said truck, formed of a bottom frame membber, a top frame member, and at least one intermediate member, each of said frame members having sides inclined inwardly to the vertical, defining a truncated pyramid shape of successively reduced size in height, length and width, the upper edge of each frame member having a pyramidal dimension conforming to the pyramidal dimension of the lower edge of the next successive frame member of reduced size enabling said frame members, in one condition, to be stacked successively edge to edge from bottom to top one upon the other to form an enlarged truncated pyramid-shaped box and in a second condition to be nested successively from top to bottom completely one within the other, said top frame having a cover, said truck having side walls formed with a curved lower edge forming runners, and wheels journalled on shafts mounted on said truck and movable to secure said wheels alternatively in an operative position outward of the curved edge and an inoperative position within the curved edge, whereby said truck may be selectively employed as a sledge or wagon.

2. The combination of claim 1, including handle means removably secured to the upper frame member.

3. The combination according to claim 2, wherein said handle means comprises a head configuration of an animal, vehicle, or mobile object.

4. The combination of claim 1, wherein said truck member comprises a rectangular frame having an upper edge having pyramidal dimensions, conforming to the lower edge of the lower frame member, enabling said lower frame to be stacked on said truck, and lateral side walls having a curved lower edge, said wheel shafts being secured between said side walls, said side walls having a slot for receipt of said wheel shafts in retracted position and means for securing said shafts.

5. The combination according to claim 1, wherein said truck comprises a pair of elongated curved rails interconnected by transverse members, and said wheel shafts are mounted so as to be rotatable between an upper and lower position corresponding to the inoperative and operative positions, respectively.

* * * * *